US005135229A

United States Patent [19]

Archer

[11] Patent Number: 5,135,229

[45] Date of Patent: Aug. 4, 1992

[54] GOLF PUTTER WITH TRAINING DEVICE

[75] Inventor: George W. Archer, Incline Village, Nev.

[73] Assignee: Bullet Golf Ball, Inc., Santa Ana, Calif.

[21] Appl. No.: 738,925

[22] Filed: Aug. 1, 1991

[51] Int. Cl.[5] ..... A63B 69/36

[52] U.S. Cl. ..... 273/186.2; 273/163 R; 273/33

[58] Field of Search ..... 273/186 A, 186 R, 183 C, 273/186 C, 193 R, 194 R, 194 A, 194 B, 163 R, 164, 33

[56] References Cited

U.S. PATENT DOCUMENTS 3,194,564 7/1965 Swan ..... 273/186 A 3,730,529 5/1973 Donofrio ..... 273/186 A

*Primary Examiner*—George J. Marlo

*Attorney, Agent, or Firm*—Edward A. Sokolski

[57] ABSTRACT

A golf putter head has a pair of spaced notches formed in the top surface of the face plate thereof. These notches run through the face plate transversely and have a width and depth suitable for removably receiving golf tees or the like in retention therein. With golf tees installed in each of the notches, such tees form spacers extending normally from the face plate, the distance between such spacers being such as to receive a golf ball therebetween with a small space to spare on either side of the ball. The golfer practices putting by striking the ball on the surface area of the face plate without the ball striking either tee. The tees are readily removable when the putter is used for actual play.

2 Claims, 2 Drawing Sheets

GOLF PUTTER WITH TRAINING DEVICE

BACKGROUND OF THE INVENTION

1. Field of the Invention

This invention relates to golf clubs and more particularly to a golf putter which has a training device in the head thereof for training a golfer to properly strike a golf ball.

2. Description of the Related Art

Many training devices have been developed for use in improving a golfer's putting game. These often take the form of alignment markers placed on the putter to facilitate striking the ball on a true line towards the hole. Such a device is described, for example, in U.S. Pat. No. 4,741,535 issued May 3, 1988 to Leonhardt.

There are advantages to using alignment devices which extend forward of the face plate of the golf head in that it is easier with such devices to properly align the striking portion of the face plate with the ball. It is not permissible, however, under the rules of the United States Golf Association to have alignment means extending in front of the face of the club head. Thus, devices of this type cannot be utilized during actual play. A device of this type could be used, however, for practice purposes. There are distinct advantages to using the same putter for both practice and play so that ideally, if such a training device extending forward of the face plate is to be used, it should be a device that is removable so that the same putter can be used for both practice and regular play.

It is an object of this invention to provide a device for training a player to putt properly which can be readily installed on and removed from a putter which is used during actual play.

It is a further object of this invention to provide a golf training device which extends forward of the face of a putter club head which can readily be removed for use during actual play.

Other objects of the invention will become apparent as the description proceeds in connection with the accompanying drawings.

BRIEF SUMMARY OF THE INVENTION

A golf putter head has a pair of spaced notches or apertures formed in the top surface of the face plate thereof. These notches or apertures run transversely through the face plate of the club head and are dimensioned to receive golf tees or other peg or pin members in removable retention therein. Such tees or peg members when installed in place on the club head form spacers which extend normally from the face of the club head. The distance between such spacers is slightly larger than the diameter of a golf ball such that the ball can fit therebetween with a small space to spare on either side of the ball. The notches and spacers are located on the club head so that the designed optimum point of impact for the face plate is midway therebetween. In practicing putting, the golfer attempts to strike the ball on the face plate of the club head without permitting the ball to strike either tee thereby perfecting the ability to strike the ball at the optimum point on the face plate. When the putter is to be used for actual play, the tees or pegs can be readily removed.

DETAILED DESCRIPTION OF THE INVENTION

Figure 1:
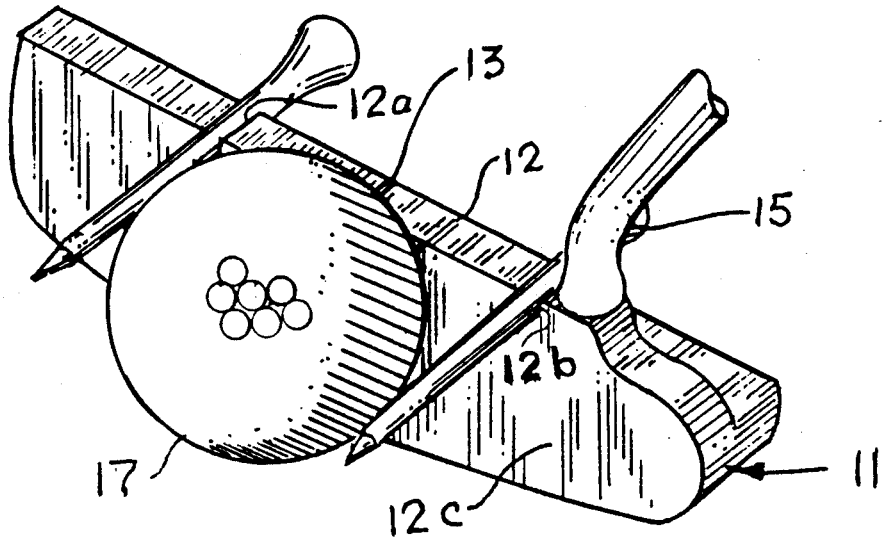
FIG. 1 is a perspective view of a preferred embodiment of the invention.
Figure 2:
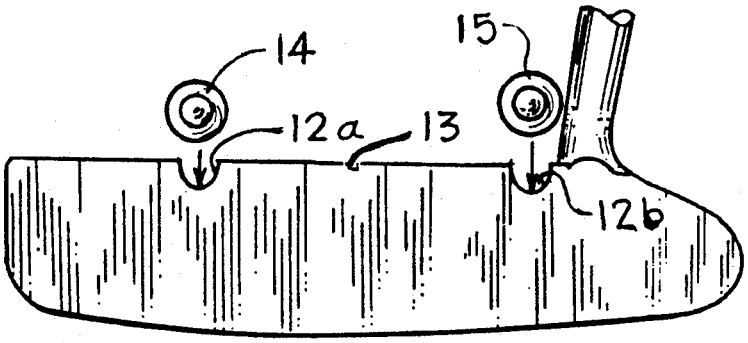
FIG. 2 is front elevational view of the preferred embodiment showing the golf tees in the process of being installed therein.
Figure 3:
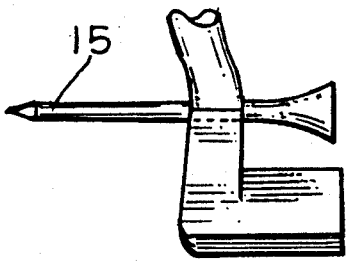
FIG. 3 is an end elevational view of the preferred embodiment.
Figure 4:
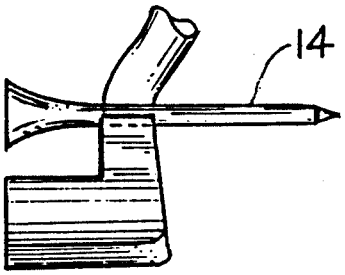
FIG. 4 is an end elevational view of the preferred embodiment taken from the end opposite to that shown in FIG. 3.
Figure 5:
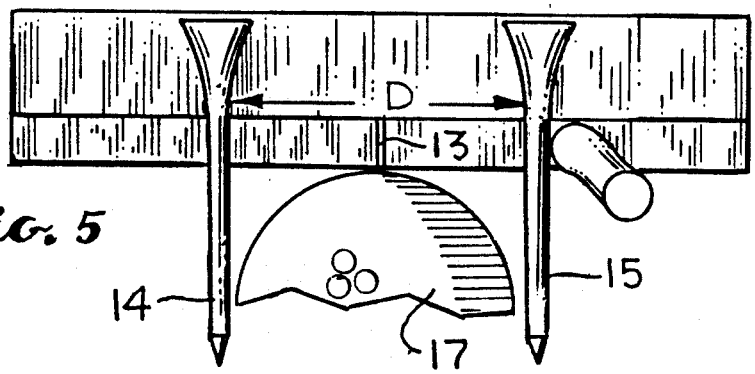
FIG. 5 is a top plan view of the preferred embodiment.
Figure 6:
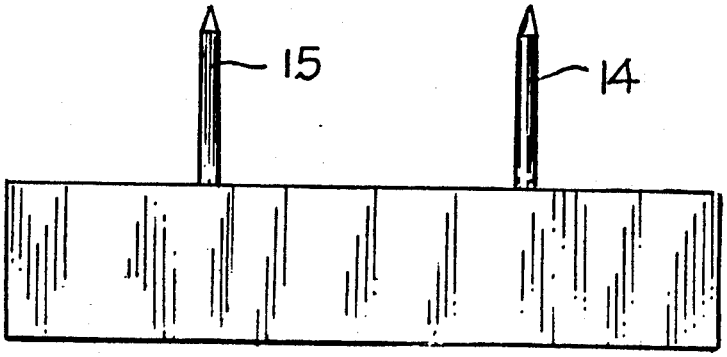
FIG. 6 is a bottom plan view of the preferred embodiment.

Referring to the drawings, a preferred embodiment of the invention is shown. Golf putter head 11 has a faceplate 12 with a pair of slots **12*a* and 12*b* formed in the top surface thereof. Such slots extend transversely across such top surface extending through the face plate at an angle which is substantially normal to face plate surface 12*c*. The distance "D" (see FIG. 5**) between the slots is slightly greater than the diameter of a conventional golf ball.

The midpoint between slots **12*a* and 12*b*, at which marker 13 is etched, is directly above the location of the desired optimum point on the club head for striking the ball. Golf tees 14 and 15 are installed in each of slots 12*a* and 12*b* respectively, such slots being designed to tightly grip the outer walls of the tees so that they are firmly held in position. Tees 14 and 15 extend normally from surface 12*c* to form a pair of spacers between which golf ball 17** fits with a small space to spare on either side.

In using the putter for practice with the tees in place, such tees provide guiding spacers for properly striking the ball. If the ball is not between the tees when it is stroked, the tees will be knocked out of place. When the putter is used for actual play, the tees are removed so that the same putter can be used for both practice and actual play.

The device of the invention can also be implemented by forming apertures other than slots in the face plate such as, for example, holes which run through the face plate which holes are made to receive the tees. Also, while tees are convenient for use as spacers, other pin members can be employed, as for example, dowels, nails, etc.

While the invention has been described and illustrated in detail, it is to be clearly understood that this is intended by way of illustration and example only and is not to be taken by way of limitation, the scope of the invention being limited only by the terms of the following claims.

We claim:

1. A golf club head with a device incorporated therein for training a golfer in the putting of a golf ball comprising:

a face plate having a broad face surface and a top surface substantially normal to said broad surface, a pair of spaced slots formed in the top surface of said face plate, and an elongated golf tee removably gripped in each of said slots and extending normally from the face surface of said face plate, said golf tees forming spacers forwardly of said face plate between which said golf ball fits, said tees being adapted to support a golf ball thereon when removed from said slots.

2. The golf club head of claim 1 wherein the distance between said slots is slightly greater than the diameter of said golf ball.

* * * * *